US006601720B2

(12) United States Patent
Meyers et al.

(10) Patent No.: US 6,601,720 B2
(45) **Date of Patent: *Aug. 5, 2003**

(54) NURSING BOTTLE

(75) Inventors: Brenda J. Meyers, Reedsburg, WI (US); David C. Brown, Chicago, IL (US); Mark P. Slaven, Evanston, IL (US)

(73) Assignee: Gerber Products Company, Fremont, MI (US)

( * ) Notice: Subject to any disclaimer, the term of this patent is extended or adjusted under 35 U.S.C. 154(b) by 0 days.

This patent is subject to a terminal disclaimer.

(21) Appl. No.: 10/180,283

(22) Filed: Jun. 26, 2002

(65) Prior Publication Data

US 2003/0024895 A1 Feb. 6, 2003

Related U.S. Application Data

(63) Continuation-in-part of application No. 09/670,903, filed on Sep. 28, 2000, now Pat. No. 6,446,822.

(51) Int. Cl.[7] ..... A61J 9/00
(52) U.S. Cl. ..... 215/11.5; 215/11.3
(58) Field of Search ..... 215/11.3, 11.4, 215/11.5, 11.6; 222/105

(56) References Cited

U.S. PATENT DOCUMENTS

| | | | |
|---|---|---|---|
| 2,555,054 | A | 5/1951 | Oliver |
| 2,804,995 | A | 9/1957 | Fee |
| 2,846,103 | A | 8/1958 | Maxwell |
| 2,887,239 | A | 5/1959 | Reed et al. |
| 2,907,485 | A | 10/1959 | Lunden |
| RE24,918 | E | 1/1961 | Mills |
| 2,987,209 | A | 6/1961 | Leonard |
| 3,118,572 | A | 1/1964 | Harding |
| 3,120,330 | A | 2/1964 | Ermecke |
| 3,134,494 | A | 5/1964 | Quinn |
| 3,200,980 | A | 8/1965 | Jamell |

(List continued on next page.)

FOREIGN PATENT DOCUMENTS

| | | |
|---|---|---|
| WO | WO 97/05853 | 2/1997 |
| WO | WO 99/11218 | 3/1999 |

*Primary Examiner*—Tri M. Mai
(74) *Attorney, Agent, or Firm*—John W. Kung

(57) ABSTRACT

The invention is an improved nursing bottle, providing a new valve within its bottom structure. A flexible disk is disposed within the bottom end cap of the nursing bottle, clamped at its periphery to the periphery of the base when the bottle is assembled. The disk has a ring of slits near its periphery which are closed when pressure inside the bottle equals ambient pressure. The slits are further sealed by contact with the base. Holes, which are sealed closed by contact with the disk, are provided in the base within a central portion which does not contact the slits in the disk. When pressure within the bottle drops, the disk bows upwardly in its center, opening the valve and allowing air to enter the bottle. When pressure within the bottle increases, the valve again closes.

12 Claims, 3 Drawing Sheets

U.S. PATENT DOCUMENTS

| | | | |
|---|---|---|---|
| 3,243,069 | A | 3/1966 | Duerme |
| 3,292,808 | A | 12/1966 | Greene |
| 3,511,407 | A | 5/1970 | Palma |
| 3,768,682 | A | 10/1973 | Meyers et al. |
| 4,154,366 | A | 5/1979 | Acres |
| 4,176,754 | A | 12/1979 | Miller |
| 4,295,582 | A | 10/1981 | Acres |
| 4,401,224 | A | 8/1983 | Alonso |
| 4,685,577 | A | 8/1987 | Chen |
| 4,730,744 | A | 3/1988 | Vinciguerra |
| 4,828,126 | A | 5/1989 | Vinciguerra |
| 4,842,165 | A | 6/1989 | Van Coney |
| 4,865,207 | A | 9/1989 | Joyner et al. |
| 4,880,125 | A | 11/1989 | LeBeau |
| 4,909,416 | A | 3/1990 | Evezich |
| 4,979,629 | A | 12/1990 | Askerneese |
| 4,984,713 | A | 1/1991 | Chambers et al. |
| 5,303,852 | A | 4/1994 | Yamawaki et al. |
| 5,318,204 | A | 6/1994 | Davis et al. |
| 5,332,121 | A | 7/1994 | Schmidt et al. |
| 5,356,016 | A | 10/1994 | Wiedemann |
| 5,431,290 | A | 7/1995 | Vinciguerra |
| 5,487,490 | A | 1/1996 | Estes |
| 5,499,729 | A | 3/1996 | Greenwood et al. |
| 5,570,796 | A | 11/1996 | Brown et al. |
| 5,607,074 | A | 3/1997 | De Gennaro |
| 5,687,861 | A | 11/1997 | Wiedemann |
| 5,687,882 | A | 11/1997 | Mueller |
| 5,692,627 | A | 12/1997 | Feng |
| 5,699,920 | A | 12/1997 | Ida et al. |
| 5,699,921 | A | 12/1997 | Rodriguez |
| 5,747,083 | A | 5/1998 | Raymond et al. |
| 5,791,503 | A | 8/1998 | Lyons |
| 5,921,426 | A | 7/1999 | Randolph |
| 5,944,205 | A | 8/1999 | LaJoie et al. |
| D417,505 | S | 12/1999 | Nuzzo |
| 6,446,822 | B1 * | 9/2002 | Meyers et al. ..... 215/11.5 |

* cited by examiner

NURSING BOTTLE

RELATED APPLICATION

This is a continuation-in-part of application Ser. No. 09/670,903 filed Sep. 28, 2000 now U.S. Pat. No. 6,446,822.

FIELD OF THE INVENTION

The present invention relates to the care of infants, specifically the feeding of infants. More specifically, the invention relates to a nurser with a fluid containing bag therein and a one-way valve which allows fluid to be expelled from the bottle through a nipple while allowing air to enter a space between the bag and the outside shell of the nurser.

BACKGROUND OF THE INVENTION

Nursing bottles, also known as baby bottles or nursers, are widely used in infant care. Specifically, nursing bottles have long been used to feed liquids to infants. Nursing bottles provide a convenient vehicle to contain liquids to be used in feeding without the risk of spillage. Further, nursing bottles provide a nipple on which the infant may use her instinctive sucking desire to consume the liquid.

Standard bottles equipped with nipples allow the infant to suck on the nipple to withdraw liquid therefrom. However, this basic bottle has drawbacks. First, the removal of liquid from the bottle creates negative pressure within the bottle, making further removal of liquid more difficult. Second, air would come to the top of the liquid containing volume of the bottle. The infant frequently consumes this air, inducing unpleasant burping, coughing or other reactions. Rigid bottles cannot be squeezed to force air out of the liquid holding volume. Third, air enters the bottle to equalize pressure, after liquid is removed. This may result in contact with the feeding liquid by contaminants.

Improving upon the standard nursing bottle, bottles have been made from flexible material, such that a user could squeeze unwanted air out of the nipple end of the bottle before presenting an infant with the bottle for feeding therefrom. The bottle typically will return to its normal shape once pressure on the shell of the bottle is removed, allowing unwanted air to reenter the bottle during feeding.

Improving further upon the standard nursing bottle, bottles have been made as hollow tubes with removable end caps. This feature allowed the user to more easily and thoroughly clean the bottle.

Collapsible bags have been provided within the interior volume of the bottle to house the liquid. Openings were placed within the walls of the bottle to allow air to enter the expanding space between the bottle shell and the collapsing bag as liquid was withdrawn therefrom. This design reduced the chance of contaminants contacting the feeding liquid, by preventing the build up of negative pressure within the liquid holding volume.

Attempts have been made to provide for a valve in the bottle. This design is desirable because it allows air to enter the bottle as liquid is withdrawn therefrom (thereby preventing the build up of negative pressure), while allowing a user to squeeze the shell of the bottle to eject unwanted air out of the nipple and liquid holding volume before presenting the bottle to the infant for feeding.

Jamell U.S. Pat. No. 3,200,980 discloses a nursing bottle with a one-way valve comprising a ball confined within a channel of variable width. The ball moves vertically within the channel responsive to pressure differences between the outside of the bottle and the inside liquid holding volume. When the ball is lifted upwardly by a pressure gradient or the bottle is inverted, air is able to pass around the ball and enter the volume within the bottle.

Chen U.S. Pat. No. 4,685,577 discloses a nursing bottle comprising an air penetrating board with one-way air-inlet apertures thereon. The air apertures are constructed of a rubber like material disposed in an upwardly angled position such that a decrease in the interior liquid holding volume in relation to the outside pressure causes the apertures to open, allowing air to pass through the barrier into the liquid holding volume.

Vinciguerra U.S. Pat. No. 5,431,290 discloses a nursing bottle with a large, single one-way valve which operates in a similar fashion as the apertures disclosed in Chen. Rodriguez U.S. Pat. No. 5,699,921 discloses a similar system for allowing air to enter the interior of a nursing bottle through a one-way valve.

Lunden U.S. Pat. No. 2,907,485 discloses a rigid bottle with a flexible reusable liner positioned therein. A check valve mounted on the bottom of the bottle includes a first flexible disk having a centrally located opening. Mounted on the first flexible disk is a second relatively thin and flexible disk, having on its outer portion a plurality of circular openings. As fluid in the reusable liner is discharged through the nipple, the second disk is raised out of contact with the first flexible disk, permitting air to flow through the centrally located opening, between the two disks, through the plurality of circular openings and into the lower portion of the bottle. The air flows into the bottle until pressure equalization allows the second disk to relax, contacting the first disk, trapping the air therein.

Greenwood U.S. Pat. No. 5,499,729 discloses a rigid bottle having a removably mounted diaphragm member with a dome-shaped central portion. The dome-shaped portion is provided with a plurality of circular apertures or slits that are sealed shut when the diaphragm is in a relaxed state. The dome-shaped portion of the diaphragm member distends axially into the bottle interior in response to a pressure differential created during liquid consumption. In the distended state, the apertures in the diaphragm open to permit air to flow into the bottle until pressure equalization is achieved.

SUMMARY OF THE INVENTION

The present invention is directed to a nursing bottle with a one-way valve made from a resiliently flexible material in combination with a corresponding end cap. The disk is responsive to pressure changes inside the bottle relative to ambient air pressure.

The bottle comprises a vertically extending cylindrical shell, which is preferably made of a resiliently flexible plastic which will regain its original shape after being squeezed. The shell defines a hollow volume therein. The upper and lower ends of the shell are preferably threaded, capable of receiving end caps. The top end cap engages the threads of the upper end and secures a nipple therebetween. A collapsible bag is preferably held in place at its open upper edge by the top end cap and upper end of the shell. Liquid for feeding an infant is to be disposed within the bag. The top end cap and top of the shell, with the nipple and edge of the bag therebetween, form a seal for the bag.

A valve is located at the bottom of the bottle where the bottom end cap engages the lower end of the shell. The bottom end cap has at least one hole, preferably disposed in a central portion. A flexible disk rests upon the inside surface of the end cap. The disk is resiliently flexible and preferably made from silicone. The outer rim of the disk is engaged between the bottom end cap and the bottom surface of the shell, thereby forming a seal for the volume within the shell. Slits, preferably located in a radially positioned ring are provided in the disk.

When the nursing bottle is exposed to ambient air pressure only, the pressure within the bottle is equal to ambient and the disk rests on the base of the bottom end cap. Separate seals prevent air flow through the valve structure. First, the slits penetrating the flexible disk are closed. Second, a seal exists between the bottom of the slits in the disc and the base of the bottom end cap. Third, a seal exists between the holes in the bottom end and the disk. Fourth, the bag and/or nipple at the top of the shell seal the interior volume at the opposite end of the shell.

When a child care giver squeezes the shell of the bottle to eject air therefrom, the shell is compressed, causing the volume between the shell and the bag to become pressurized. The increased pressure pushes down upon the flexible disk, thereby further sealing the bottom end cap. The slits in the disk remain closed. Having no other means of pressure equalization, the increased pressure within the shell squeezes the collapsible bag, thereby forcing fluid out of the bag through the nipple. Once the care giver releases her squeeze on the bottle, the shell resiliently expands to its normal shape. The volume expansion causes a drop in pressure or a partial vacuum within the bottle. In the presence of the vacuum, ambient outside pressure acts on the flexible disk through holes in the bottom end cap. The disk bows slightly upward into the bottle, thereby opening the slits as the flexible material expands upwardly. With the seal open, air rushes into the volume between the shell and the collapsed bag, thereby equalizing the pressure. Air generally will not reenter the collapsed bag through the nipple because the valve provides a path of lesser resistance than does the aperture of the nipple.

BRIEF DESCRIPTION OF THE DRAWINGS

For the purpose of illustrating the invention, there is shown in the drawings a form which is presently preferred; it being understood, however, that this invention is not limited to the precise arrangements and instrumentalities shown.

DETAILED DESCRIPTION OF THE DRAWINGS

Figure 1:
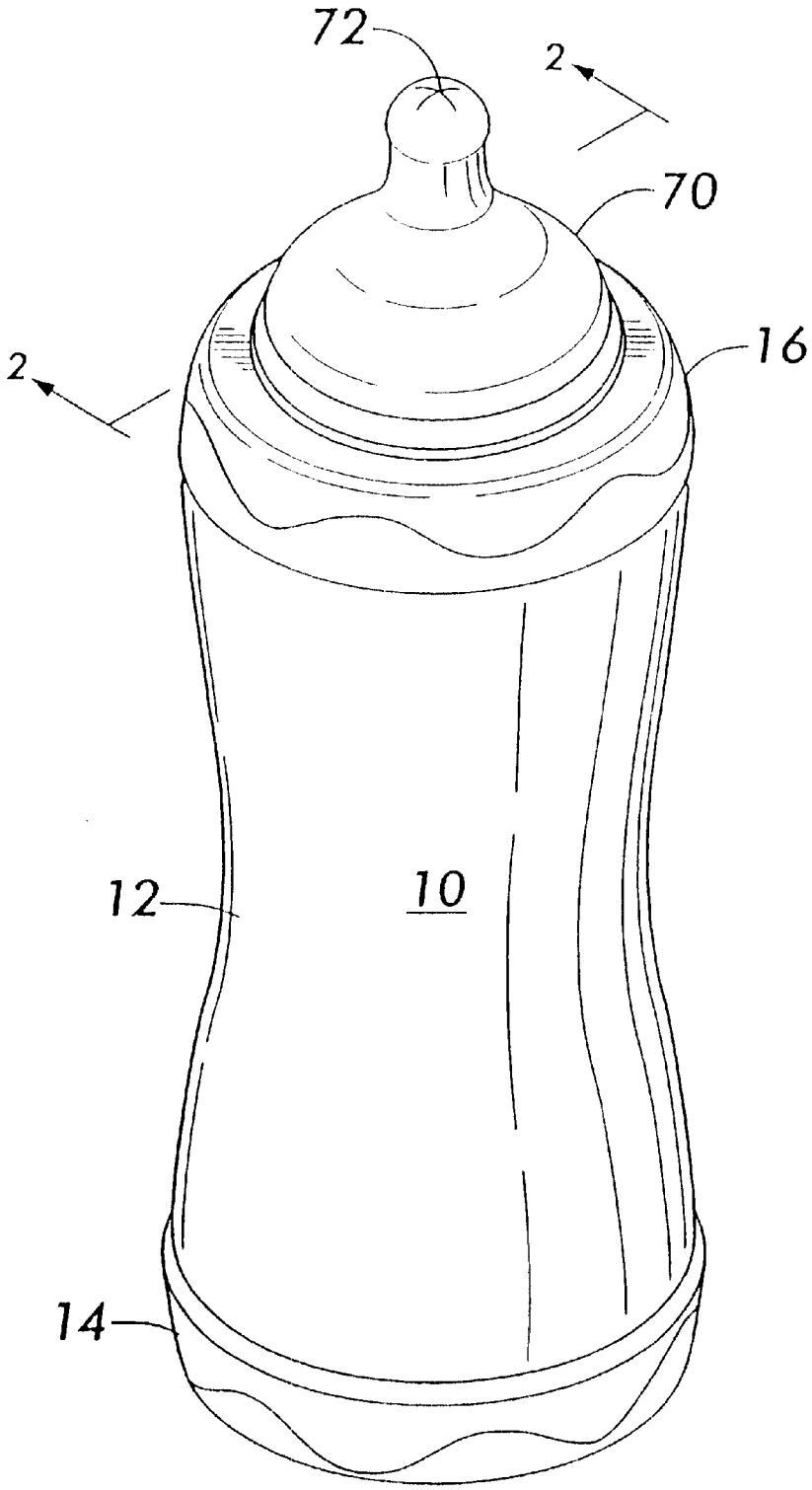
FIG. 1 is an isometric view of a nursing bottle according to the preferred embodiment of the present invention.
Figure 2:
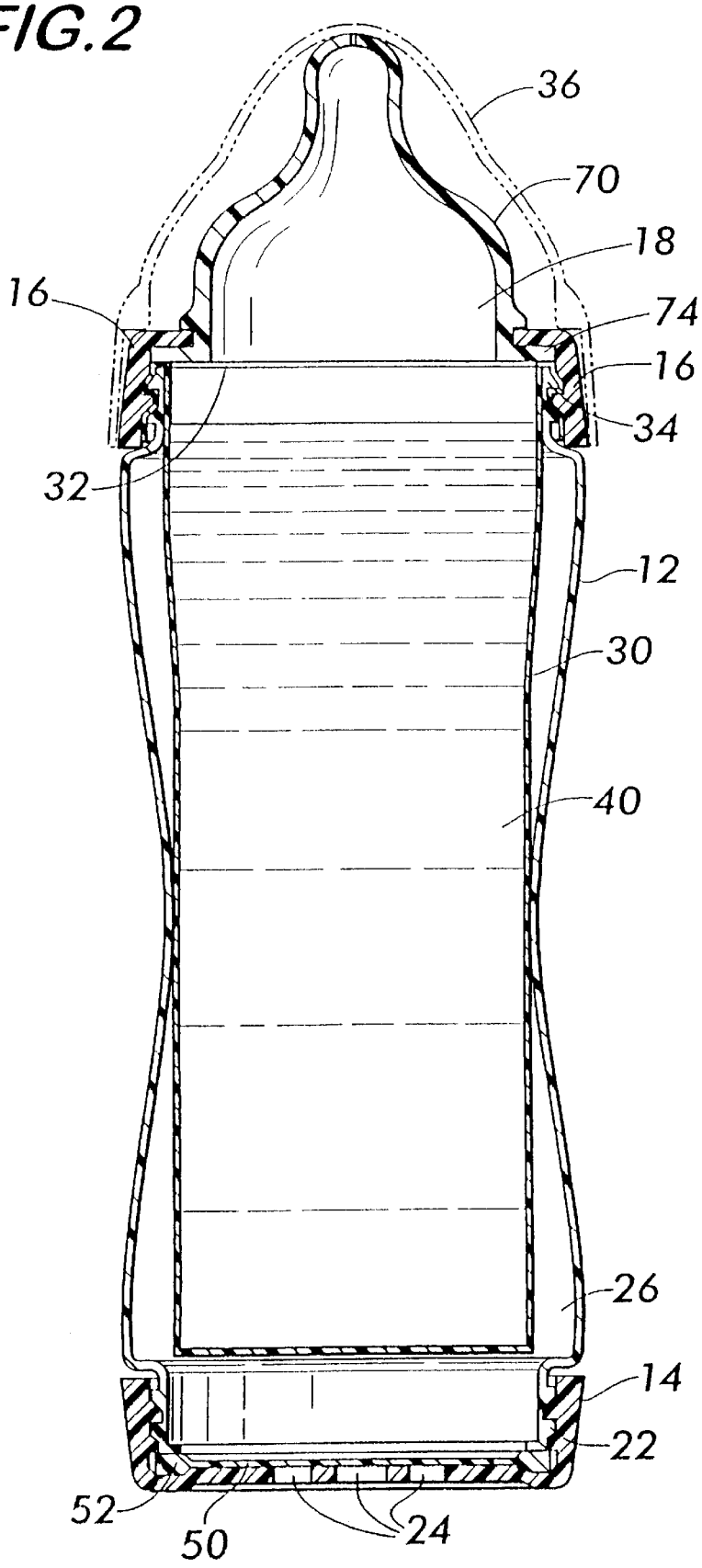
FIG. 2 is a cross sectional view of the embodiment taken across line 2—2 in FIG. 1.

Referring to drawings where like numerals identify like elements there is shown in FIGS. 1 and 2 a nursing bottle which is generally identified by the numeral 10. The bottle comprises a vertically extending, preferably tapered in the middle, tubular shell 12. Shell 12 is ideally made from a flexible plastic material which will flex under pressure but regain its normal shape upon release. The shell surrounds and defines an empty space or volume 26. The shell 12 preferably has an upper end having a reduced diameter with threads 34 extending around the exterior thereof. The shell 12 preferably has a lower end also having threads 22 thereon. In its most preferred embodiment, the diameters and threads of the upper and lower ends are identical such that the end caps, described below, are interchangeable. In fact, it is preferred that shell 12 have a cross section which is symmetric about the shell's mid section. The top end cap 16 and bottom end cap 14 preferably interchangeably engage the other's respective end.

A collapsible bag 30 is preferably disposed within the shell defining a volume 40 for receiving and holding fluids. Bag 30 has a rim 32 which rests on top of the top extreme of shell 12. The bag 30 is retained within the space 26 defined by the shell 12.

Top end cap 16 is shaped in the form of a ring preferably having threads on its inside surface capable of engaging threads 34 on the shell. The upper portion of the ring extends inwardly beyond the threads. The ring defines a hole 18, through which a nipple 70 may be inserted. The nipple 70 has an aperture 72 near its top, A base with a flange 74 having a larger diameter than the ring (upper portion of top end cap 16) is also provided. Thus, the nipple will be secured under the ring and will not pass through the ring entirely. The contents within the bag 30 are in fluid communication with nipple 70 (i.e. free to enter the nipple if the bottle is inverted or suction and/or pressure is applied). The engagement of the nipple 70 and the bag 30 with top end cap 16 and shell 12 also provides a seal. Also, as illustrated in phantom in FIG. 2, a cap 36 may be removably mounted on top of the nursing bottle, engaging the outside of top end cap 16 and concealing the nipple 70.

Figure 3:
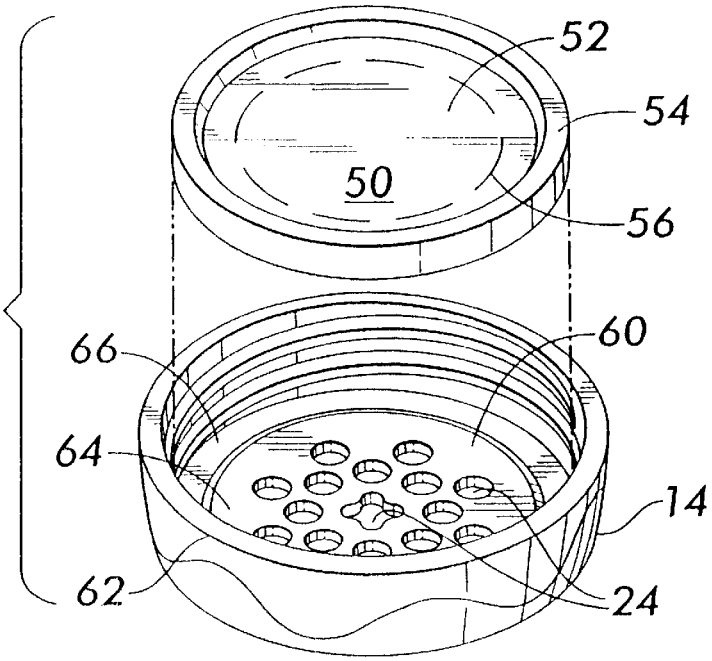
FIG. 3 is an isometric view showing the relationship between the bottom cap structure and a flexible disk.
Figure 4:
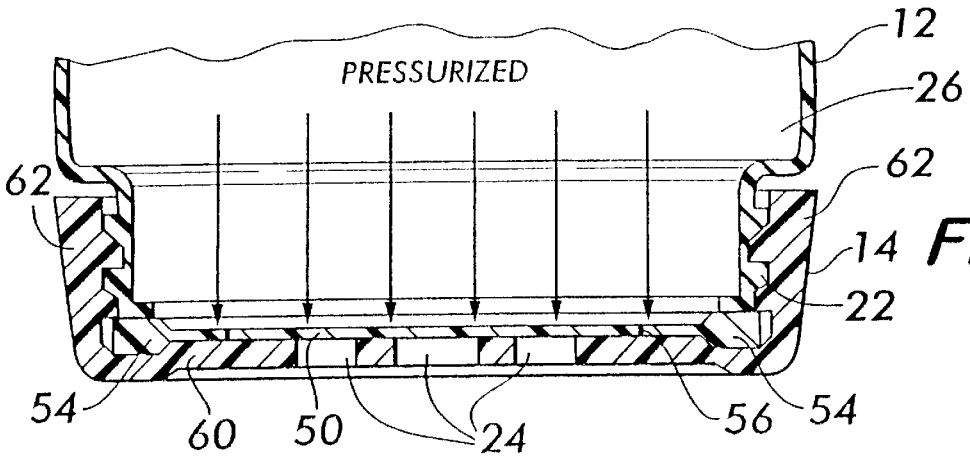
FIG. 4 is a cross sectional view of the bottom portion of the nursing bottle and cap structure while the bottle is in an equalized or increased pressure state (i.e., the disk is relaxed).
Figure 5:
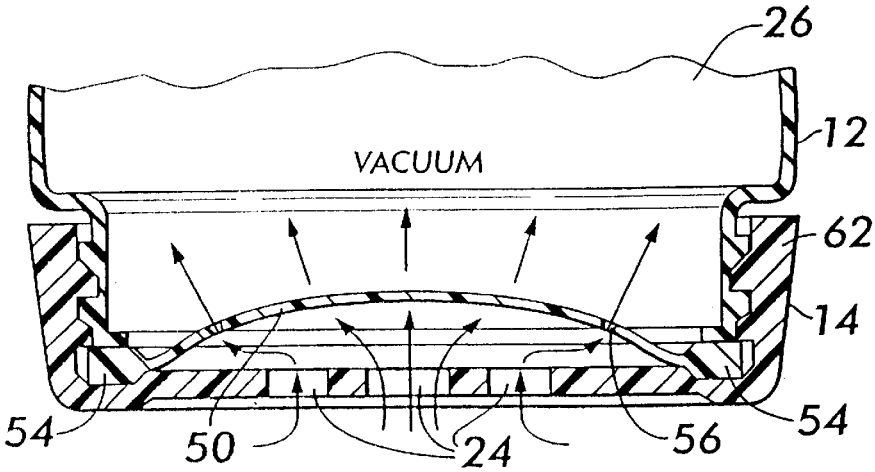
FIG. 5 is the same view as FIG. 4 while a reduced pressure or partial vacuum exists within the bottle.

Referring now to FIGS. 3–5, bottom end cap 14 comprises a circular base 60 and a preferably threaded collar 62 extending vertically from the circumference thereof. The threads of collar 62 engage the threads 22 of the shell 12. As shown in FIG. 3, base 60 preferably has a circular inner portion 64 and a slightly depressed outer ring portion or groove 66 between inner portion 64 and collar 62. Inner portion 64 has at least one hole 24 therein. In the most preferred embodiment the holes 24 comprise a centrally located hole having a cross-like shape and a plurality of round holes extending radially therefrom.

Disk 50 is a rubber-like flexible disk, preferably made from silicone. Disk 50 is preferably reversible, i.e. it is identical in structure and function when viewed from the top and from the bottom. Referring to FIG. 3, disk 50 preferably comprises a flat central portion 52 and a thicker projecting outer rim portion 54, the rim portion 54 preferably extending both above and below central portion 52. Ideally, the distance in which rim portion 54 extends either above or below central portion 52 is equal to the distance which the groove 66 is depressed below the inner portion 64 of the base 60 of bottom end cap 14. Further, the width of rim portion 54 should correspond with the width of groove 66; and the overall radius of disk 50 should correspond with the overall radius of base 60. When the nursing bottle is assembled, outer rim portion 54 provides a substantially airtight seal between volume 26 and the outside air.

Flat central portion 52 of disk 50 is provided with at least one, but preferably a plurality of slits 56 arranged radially from the center of the disk. For reasons which will become apparent below, slits 56 can be located farther from the center of the disk than the greatest distance from the center of base 60 to the outer edge of the furthest hole 24. In this configuration, however, slits 56 should be nearer to the center of disk 50 than the depressed outer ring portion 66 is from the center of base 60. Alternatively, slits 56 can be positioned anywhere along disk 50 provided that it is in contact with base 60 instead of any of holes 24 in the bottom end cap 14 when disk 50 is in a relaxed state. Thus, slits 56 can reside anywhere along disk 50 provided that slits 56, when closed, are in direct contact with base 60, not any of holes 24 residing in base 60. Thus, when disk 50 is in a relaxed state, each slit 56 is flush against basde 60 and not against any of holes 24. As shown in FIGS. 3 and 4, disk 50 is therefore receivable by and fits snugly within bottom end cap 14.

As shown in FIG. 4, when disk 50 is engaged with bottom end cap 14, bottom end cap 14 may be screwed onto the lower end of shell 12, engaging threads 22. In this configuration, the bottom of shell 12, contacts the outer rim portion 54 of disk 50, securing outer rim portion 54 between itself and groove 66 of bottom end cap 14. The circumference of disk 50 is thereby securely fixed relative to the shell 12 and bottom end cap 14.

Still referring to FIG. 4, disk 50 is in a relaxed state because pressure within the bottle is equal to or greater than ambient pressure outside the bottle. Central portion 52 of disk 50 contacts and seals holes 24 in bottom end cap 14, preventing airflow therethrough. In addition, slits 56 are closed, preventing airflow through the disk. Still further, slits 56 are sealed by way of contact with base 60.

If pressure is placed on shell 12, such as by squeezing, pressure is increased within volume 26. As seen in FIG. 4, this pressure pushes down on disk 50, causing it to push against base 60. The force of the pressure forms an airtight seal between the base 60 and disk 50. No airflow can occur between volume 26 and the outside air. First, slits 56 are closed. Second, an airtight seal exists between slits 56 and base 60. Third, an airtight seal exists between holes 24 and disk 50.

Having no other opportunity to equalize, the pressure inside volume 26 places a resulting pressure on collapsible bag 30, squeezing the contents of bag 30 out of the nursing bottle through aperture 72 of nipple 70 and partially collapsing bag 30.

Once pressure is removed from the shell 12 (i.e. when the user discontinues squeezing), shell 12 returns to its normal relaxed state, creating a partial vacuum within volume 26. As shown in FIG. 5, the outside air pressure exerts force on disk 50 through holes 24. The outside air pressure, in the presence of the vacuum within volume 26, forces disk 50 to bow upwardly into volume 26. While the disk is stretched, the seal is opened to airflow. First, the slits 56 are stretched opened as the elastomeric substance of disc 50 stretches. Second, slits 56 are separated from base 60. Third, disk 50 is lifted away from holes 24. The lowering of disk 50 allows outside air to rush into volume 26; thus preventing collapsible bag 30 from re-expanding and ultimately preventing air from reentering bag 30 through nipple 70 because aperture 72 of nipple 70 generally provides greater resistance to air flow than do the openings through holes 24 and slits 56.

The present invention may be embodied in other specific forms without departing from the spirit or essential attributes thereof and, accordingly, reference should be made to the appended claims, rather than to the foregoing specification, as indicating the scope of the invention.

We claim:

1. A nursing bottle comprising:

a tubular flexible shell having a lower end and an upper end;

a bottom end cap removably engaged with the lower end, the bottom end cap having a plurality of holes therethrough;

a top end cap removably engaged with the upper end, said top end cap capable of receiving a nipple;

a bag disposed within the shell, defining an open volume between the shell and the bag, the bag being open to the nipple when the nipple is installed; and a resiliently flexible flat disk having a plurality of slits therethrough, the slits being closed to airflow when pressure inside the bottle is greater than ambient pressure, the slits being open to airflow when pressure inside the bottle is less than ambient pressure, and the disk being disposed within the bottom end cap such that the disk is secured between a base of the bottom end cap and the shell;

wherein the slits directly contact the base when the disk is in a relaxed state.

2. The nursing bottle of claim 1 wherein the slits are radially arranged about a center of the disk.

3. The nursing bottle of claim 1 wherein:

the nipple has an aperture; and the holes in the base and the slits in the disk providing a path of lesser resistance than the aperture of the nipple for airflow when the disk is bowed.

4. The nursing bottle of claim 1 wherein a liquid is disposed within the bag.

5. The nursing bottle of claim 1 wherein the shell is tapered in the middle.

6. The nursing bottle of claim 1 wherein:

the disk further comprises a projecting outer rim;

the bottom end cap further comprises a base having a groove adjacent an outer edge of the base; and the projecting outer rim engages the groove of the base.

7. The nursing bottle of claim 6 wherein the disk is reversible.

8. The nursing bottle of claim 1 wherein air cannot pass through the slits in the disk when pressure inside the bottle is equal to ambient pressure.

9. The nursing bottle of claim 1 wherein:

the disk is in contact with the holes in the base while the disk is relaxed, thereby preventing airflow through the at least one hole; and the base is in contact with the slits in the disk while the disk is relaxed, thereby preventing airflow through the slits.

10. The nursing bottle of claim 1 wherein the upper and lower ends have equal diameters and substantially identical threads.

11. The nursing bottle of claim 10 wherein the diameters of the upper and lower ends are reduced in comparison with the remainder of the shell.

12. The nursing bottle of claim 1 wherein the top and bottom end caps are engaged with the shell by threads.

* * * * *